US007409177B2

(12) United States Patent
Murano et al.

(10) Patent No.: US 7,409,177 B2
(45) Date of Patent: Aug. 5, 2008

(54) METHOD AND APPARATUS FOR IMAGE FORMING CAPABLE OF EFFECTIVELY POSITIONING A SUPPORTING MEMBER

(75) Inventors: Junichi Murano, Saitama (JP); Kazuyoshi Matsumoto, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 187 days.

(21) Appl. No.: 11/376,226

(22) Filed: Mar. 16, 2006

(65) Prior Publication Data

US 2006/0210305 A1 Sep. 21, 2006

(30) Foreign Application Priority Data

Mar. 17, 2005 (JP) ..... 2005-077128

(51) Int. Cl.
*G03G 15/00* (2006.01)

(52) U.S. Cl. ..... 399/117

(58) Field of Classification Search ..... 399/116, 399/117; 100/170, 171, 342
See application file for complete search history.

(56) References Cited

U.S. PATENT DOCUMENTS

| | | | |
|---|---|---|---|
| 5,552,857 | A | 9/1996 | Ishikawa et al. |
| 6,257,134 | B1 | 7/2001 | Zuber et al. |
| 6,453,136 | B1 | 9/2002 | Yasumaru |
| 2003/0047407 | A1 | 3/2003 | Murano et al. |
| 2004/0182048 | A1 | 9/2004 | Matsumoto et al. |
| 2005/0095032 | A1 | 5/2005 | Murano et al. |

FOREIGN PATENT DOCUMENTS

| | | |
|---|---|---|
| EP | 1607806 A1 | 12/2005 |
| JP | 63-188675 | 12/1988 |
| JP | 2001-194866 | 7/2001 |
| JP | 2001-242671 | 9/2001 |
| JP | 2002-034708 | 2/2002 |
| JP | 2002-233902 | 8/2004 |
| JP | 2001-246000 | 9/2004 |

OTHER PUBLICATIONS

European Patent Office Examination Report dated Mar. 30, 2007, for corresponding European Patent Application No. 06004411.2-1240.

*Primary Examiner*—Hoang Ngo
(74) *Attorney, Agent, or Firm*—Harness, Dickey & Pierce, P.L.C.

(57) ABSTRACT

An image forming apparatus includes an image bearing member configured to bear an image on a surface thereof, an image bearing member supporting member configured to support the image bearing member, a sliding member having a guide portion, a positioning member configured to be detachably positioned at a given position on the sliding member and including a fitting portion that has planes and that is configured to fit with image bearing member supporting member while the positioning member being positioned at the given position, and a pressing member configured to press the image bearing member supporting member toward the planes of the fitting portion and having the pressing member having a V-shaped portion so that the V-shaped portion is pushed between the guide portion and the image bearing member supporting member to press the image bearing member supporting member.

20 Claims, 7 Drawing Sheets

METHOD AND APPARATUS FOR IMAGE FORMING CAPABLE OF EFFECTIVELY POSITIONING A SUPPORTING MEMBER

PRIORITY STATEMENT

The present patent application claims priority under 35 U.S.C. §1.119 upon Japanese patent application no. 2005-077128, filed in the Japan Patent Office on Mar. 17, 2005, the disclosure of which is incorporated by reference herein in its entirety.

BACKGROUND

It is well known that a conventional image forming apparatus including an electrophotographic copier, printer, facsimile machine, multi-functional machine and so forth has a technique that can position an image bearing member supporting member.

In the image forming apparatus having the above-described technique, it is necessary to properly position and mount the image bearing member with respect to a main body of the image forming apparatus to form a high quality image on an image bearing member.

Therefore, a conventional image forming apparatus has a structure, for example as disclosed in Japanese Laid-open Patent Application Publication No. 2004-233902, that includes a positioning member that is positioned and mounted to a mounting position with respect to a frame of the main body of the image forming apparatus. When the positioning member is mounted on the mounting position, an image bearing member supporting member is fitted into the mounting hole formed on the positioning member to position the image bearing member supporting member. Thereby, the image bearing member can be properly positioned on the main body of the image forming apparatus.

In this case, however, the amount of rotation speed deviation element drive gear during maintenance and/or replacement of the photoconductive element. The mounting hole is used as a tooling hole or a fitting portion for the image bearing member supporting member.

In the above-described conventional image forming apparatus, however, the image bearing member supporting member is fitted into the mounting hole of the positioning member to position the image bearing member supporting member with respect to the positioning member. That is, the mounting hole does not have a great amount of play, which makes it difficult to fit the image bearing member supporting member into the mounting hole, and the image forming apparatus has a disadvantage in the operability of positioning the image bearing member supporting member.

SUMMARY OF THE INVENTION

One or more embodiments of the present invention have arisen in view of the above-mentioned circumstances.

One or more embodiments of the present invention provide an image forming apparatus that can effectively position an image bearing member supporting member to a positioning member mounted on the image forming apparatus.

One or more embodiments of the present invention provide a method of positioning the image bearing member supporting member properly to the above-described image forming apparatus.

An embodiment of the present invention provides an image forming apparatus that includes an image bearing member, an image bearing member supporting member, a sliding member, a positioning member, and a pressing member. The image bearing member is configured to bear an image on a surface thereof. The image bearing member supporting member is configured to support the image bearing member. The sliding member has a guide portion. The positioning member is configured to be detachably positioned at a given position on the sliding member. The positioning member includes a fitting portion having planes and configured to fit with image bearing member supporting member while the positioning member being positioned at the given position. The pressing member is configured to press the image bearing member supporting member toward the planes of the fitting portion. The pressing member has a V-shaped portion so that the V-shaped portion is pushed between the guide portion and the image bearing member supporting member to press the image bearing member supporting member.

An embodiment of the present invention provides such an image forming apparatus in which the sliding member may be configured to move between first and second positions and that further includes a regulating member mounted thereon configured to regulate a movement of the pressing member. The pressing member may be movably supported by the positioning member while biased by a spring, both ends of which are locked by the sliding member and the pressing member.

When the sliding member is located at the first position, the pressing member biased by the spring may be regulated by the regulating member to stay away from the image bearing member supporting member.

When the sliding member leaves from the first position for the second position, the pressing member may move together with the sliding member.

When the sliding member comes to a third position located between the first and the second positions, the V-shaped portion may be pushed to a position between the guide portion and the image bearing member supporting member, and then is stopped.

When the sliding member further moves toward the second position, the pressing member may be released from a force exerted by the regulating member.

An embodiment of the present invention provides a method for positioning an image bearing member supporting member, the method including the steps of mounting the image bearing member supporting member to an image forming apparatus, closing a cover of the image forming apparatus to fit the image bearing member supporting member into a fitting hole formed on a positioning member mounted with respect to the cover, moving a sliding member in a given direction, contacting a pressing member mounted on the sliding member with the image bearing member supporting member, moving the sliding member to a given position, pushing a V-shaped portion of the pressing member between a guide portion of the sliding member and the image bearing member supporting member to press the image bearing member supporting member, and engaging the image bearing member supporting member with the positioning member.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
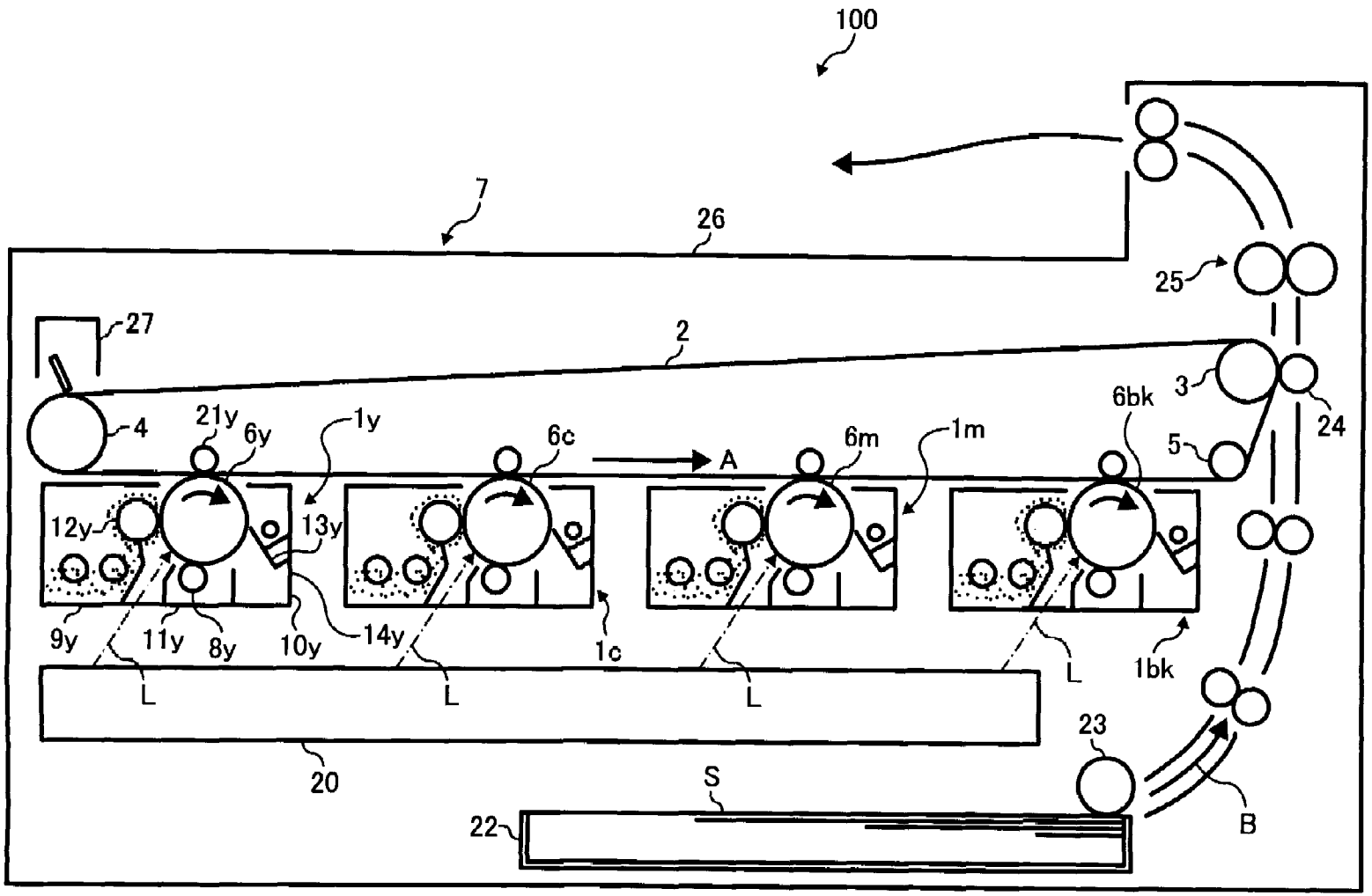
FIG. 1 is a schematic structure of an image forming apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Figure 2:
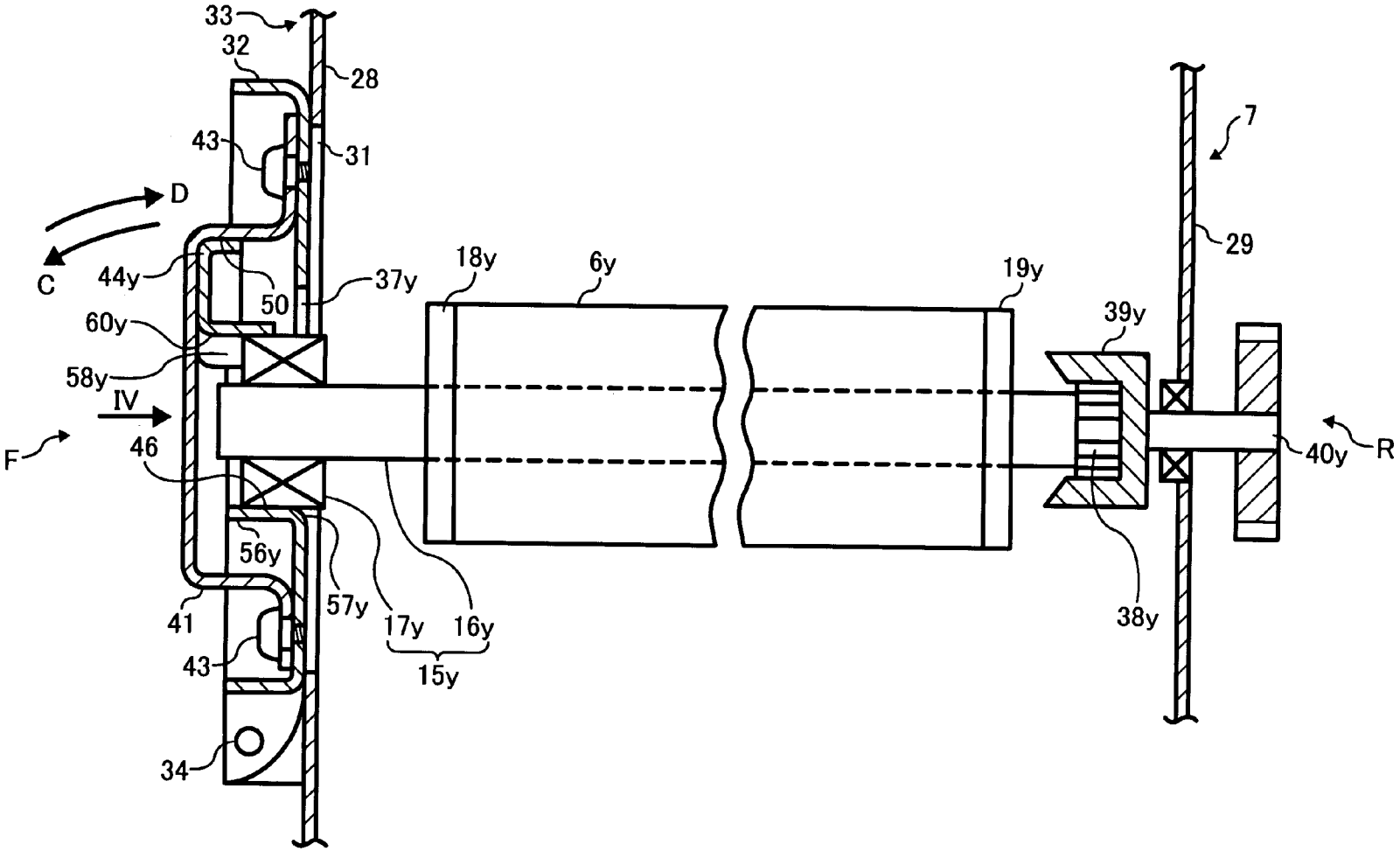
FIG. 2 is a cross sectional view (according to an example embodiment of the present invention) of a process cartridge of the image forming apparatus of FIG. 1.
Figure 3:
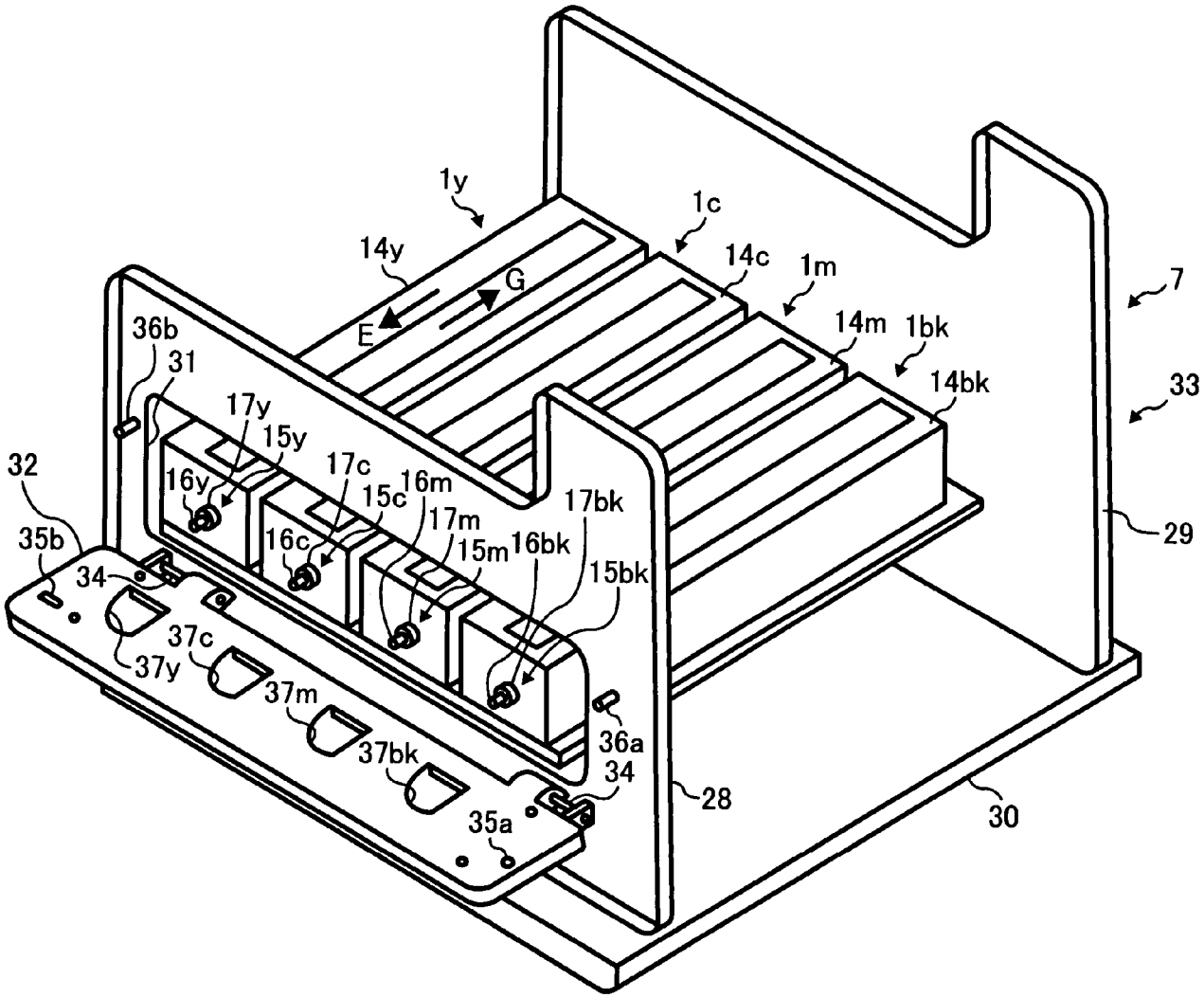
FIG. 3 is a perspective view (according to an example embodiment of the present invention) of a schematic structure of a frame of a main body of the image forming apparatus, process cartridges mounted to the image forming apparatus, and a positioning member on the image forming apparatus.

Referring to FIGS. 1, 2, and 3, a schematic structure of an image forming apparatus 100 is described according to one or more example embodiments of the present invention.

In FIG. 1, the image forming apparatus 100 includes a main body 7, a plurality of process cartridges of 1*y*, 1*c*, 1*m*, and 1*bk*, and an intermediate transfer belt 2.

The plurality of process cartridges 1*y*, 1*c*, 1*m*, and 1*bk* are disposed in the main body 7 of the image forming apparatus 1.

The intermediate transfer belt 2 is disposed opposite to the plurality of process cartridges 1*y*, 1*c*, 1*m*, and 1*bk*. The intermediate transfer belt 2 forms an endless belt extending over a plurality of supporting rollers 3, 4, and 5.

The plurality of process cartridges 1*y*, 1*c*, 1*m*, and 1*bk* include a plurality of respective image bearing members 6*y*, 6*c*, 6*m*, and 6*bk* serving as a drum-shaped photoconductive element, and perform image forming operations for producing respective toner images with toners of different colors of yellow (y), magenta (m), cyan (c), and black (bk). Each of the toner images are transferred onto the intermediate transfer belt 2. Since the above described components indicated by y, c, m, and bk used for the image forming operations have similar structures and functions, except that respective toner images formed thereon are of different colors, which are yellow, magenta, cyan, and black toners, the discussion in FIG. 2 uses reference numerals for specifying components of the color image forming apparatus 100 with the suffix of color of "y".

The process cartridge 1*y* includes the image bearing member 6*y* and other image forming components arranged around the image bearing member 6*y*, for example, a charging unit 11*y* having a charging roller 8*y*, a developing unit 9*y* having a developing roller 12*y*, and a cleaning unit 10*y* having a cleaning blade 13*y*. The developing unit 9*y*, the cleaning unit 10*y*, and a charging unit 11*y* are included in a unit case 14*y*.

FIG. 2 shows a schematic structure of the process cartridge 1*y*, focusing on a structure around the image bearing member 6*y*. The process cartridge 1*y* further include a supporting member 15*y* that supports the image bearing member 6*y*. Other components and parts of the process cartridge 1*y* are not shown in FIG. 2. The supporting member 15*y* includes a supporting shaft 16*y* and a bearing 17*y*. The supporting shaft 16*y* supports the image bearing member 6*y*. The bearing 17*y*, for example a ball bearing, is mounted on the supporting shaft 16*y*. The image bearing member 6*y* has flanges 18*y* and 19*y* at both ends, and is fixedly supported to the supporting shaft 16*y* via the flanges 18*y* and 19*y*. The supporting shaft 16*y* is rotatably mounted via a bearing (not shown) to the unit case 14*y* shown in FIG. 1.

When a series of image forming operations starts, the image bearing member 6*y* is driven to rotate by a motor (not shown) in a clockwise direction in FIG. 1, and the intermediate transfer belt 2 is driven to rotate by a motor (not shown) in a direction as indicated by arrow A. At this time, the charging roller 8*y* of the charging unit 11*y* is rotated while contacting a surface of image bearing member 6*y*, thereby the image bearing member 6*y* is charged to an appropriate polarity. The image forming apparatus 100 further includes an optical writing unit 20 as shown in FIG. 1. The optical writing unit 20 emits a laser beam L that is deflected in the optical writing unit 20 to irradiate a surface of the charged image bearing member 6*y* so that an electrostatic latent image can be formed on the surface of the image bearing member 6*y*.

The developing roller 12*y* of the developing unit 9*y* is driven to rotate by a motor (not shown) in a counterclockwise direction in FIG. 1. The developing roller 12*y* bears and coveys dry developer on its surface. Yellow toner in the dry developer conveyed by the developing roller 12*y* is statically transferred onto the electrostatic latent image formed on the surface of the image bearing member 6*y*, thereby the electrostatic latent image turns to a yellow toner image. A primary transfer roller 21*y* is disposed opposite to the process cartridge 1, sandwiching the intermediate transfer belt 2. The primary transfer roller 21*y* forms a primary transfer nip between the image bearing member 6*y* and the primary transfer roller 21*y* so that the yellow toner image formed on the surface of the image bearing member 6*y* is transferred onto the intermediate transfer belt 2. Residual toner adhering on the surface of the image bearing member 6*y* remaining after the yellow toner image is transferred is removed from the surface of the image bearing member 6*y* by the cleaning blade 13*y* of the cleaning unit 10*y*.

The similar image forming operations as described above are performed for the process cartridges 1*c*, 1*m*, and 1*bk*. That is, a cyan toner image, a magenta toner image, and a black toner image are formed on the respective image bearing members 6*c*, 6*m*, and 6*bk*, and the cyan, magenta, and black toner images are sequentially laid on the yellow toner image transferred on the intermediate transfer belt 2.

The image forming apparatus 100 further includes a sheet feeding cassette 22 having a sheet feeding roller 23. The sheet feeding cassette 22 is disposed below the main body 7 of the image forming apparatus 100 as shown in FIG. 1. The sheet feeding cassette 22 holds a stack of recording media including a recording medium S placed on the top of the recording media. The sheet feeding roller 23 is rotated to feed the recording medium S in a direction as indicated by arrow B. The recording medium S is fed from the sheet feeding cassette 22, and is conveyed to a position between the intermediate transfer belt 2 and a secondary transfer roller 24 disposed opposite to the intermediate transfer belt 2. A secondary transfer nip is formed between the supporting roller 3 and the secondary transfer roller 24 so that the overlaid toner image formed on intermediate transfer belt 2 is transferred onto the recording medium S. The recording medium S having the overlaid toner image thereon is further conveyed upwardly to a fixing unit 25. The fixing unit 25 fixes the overlaid toner image by heat and pressure.

After passing the fixing unit 25, the recording medium S is discharged to a sheet discharging part 26 formed on top of the main body 7 of the image forming apparatus 100.

Further, residual toner remaining on the intermediate transfer belt 2 after the transfer of the overlaid toner image is removed by a belt cleaning unit 27.

In FIG. 2, the reference number "F" indicates a front side or a near side of the image forming apparatus 100, and the reference number "R" indicates a far side or a rear side of the image forming apparatus 100. The process cartridges 1*y*, 1*c*, 1*m*, and 1*bk* are detachably disposed in the main body 7 of the image forming apparatus 100. Details of the structure of the main body 7 will be described later.

The image forming apparatus 100 further includes a frame 33 in the main body 7. The frame 33 includes a front side plate 28 and a rear side plate 29, both of which are shown in FIGS. 2 and 3, and a bottom plate 30 shown in FIG. 3. The front side plate 28 is disposed at the near side of the image forming apparatus 100, and rear side plate 29 is disposed at the far side of the image forming apparatus 100. The front and rear side plates 28 and 29 are fixedly attached to the bottom plate 30. The front side plate 28 includes an opening 31 that is regularly covered by a positioning member 32 as shown in FIG. 2. The image forming apparatus further includes an outer cover (not shown) and a front cover (not shown), both of which are disposed around the frame 33 and the positioning member 32.

In FIG. 3, the process cartridges 1*c*, 1*m*, and 1*bk* have unit cases 14*c*, 14*m*, and 14*bk*, respectively. The process cartridges 1*c*, 1*m*, and 1*bk* also have supporting members 15*c*, 15*m*, and 15*bk*, respectively, to support the image bearing members 6*c*, 6*m*, and 6*bk*, respectively. The supporting members 15*c*, 15*m*, and 15*bk* have supporting shafts 16*c*, 16*m*, and 16*bk*, respectively, and bearings 17*c*, 17*m*, and 17*bk*, respectively. The supporting shafts 16*c*, 16*m*, and 16*bk* supports the image bearing members 6*c*, 6*m*, and 6*bk* of the process cartridges 1*c*, 1*m*, and 1*bk*. The bearings 17*c*, 17*m*, and 17*bk* are mounted on the near side of the supporting shafts 16*c*, 16*m*, and 16*bk*, respectively.

As shown in FIGS. 2 and 3, the positioning member 32 is mounted with respect to the front side plate 28 via a pair of hinge pins 34. The positioning member 32 is rotatable in directions as indicated by arrows C and D in FIG. 2. FIG. 2 shows the positioning member 32 at its closed position. When the positioning member 32 is at the closed position, a positioning hole 35*a* formed on the positioning member 32 is engaged with a positioning pin 36*a* fixedly protruded on the front side plate 28 and a positioning hole 35*b* formed on the positioning member 32 is engaged with a positioning pin 36*b* fixedly protruded on the front side plate 28. Thus, the positioning member 32 is positioned by being engaged with the frame 33 of the main body 7 of the image forming apparatus 100. The closed position of the positioning member 32 is also identified as a mounting position of the positioning member 32 with respect to the frame 33 of the image forming apparatus 100. Thus, the positioning member 32 is detachably mounted on the image forming apparatus 100 by being positioned at the mounting position with respect to the frame 33 of the main body 7 of the image forming apparatus 100.

Further, as shown in FIG. 3, the positioning member 32 includes mounting holes 37*y*, 37*c*, 37*m*, and 37*bk* serving as a fitting portion. When the positioning member 32 is closed as shown in FIG. 2, that is, when the positioning member 32 is at the mounting position, the bearings 17*y*, 17*c*, 17*m*, and 17*bk* are received into the mounting holes 37*y*, 37*c*, 37*m*, and 37*bk*, respectively, of the supporting member 15*ym* 15*c*, 15*m*, and 15*bk*, respectively. By fitting the bearings 17*y*, 17*c*, 17*m*, and 17*bk* into the mounting holes 37*y*, 37*c*, 37*m*, and 37*bk*, respectively, the near side of the supporting members 15*y*, 15*c*, 15*m*, and 15*bk* are positioned with respect to the positioning member 32. Thus, the mounting holes 37*y*, 37*c*, 37*m*, and 37*bk* formed on the positioning member 32 are utilized to fit with the supporting members 15*y*, 15*c*, 15*m*, and 15*bk* while the positioning member 32 is disposed in the mounting position.

On the other hand, as shown in FIG. 2, the supporting shaft 16*y* has an image bearing member gear 38*y* fixedly mounted at the end portion of the far side of the supporting shaft 16*y*. The rear side plate 29 has a cup-shaped gear 39*y* and its shaft 40*y* that is rotatably supported thereon. The image bearing member gear 38*y* is detachably engaged with the cup-shaped gear 39*y*. With the above-described structure, the end portion of the far side of the supporting shaft 16*y* is positioned with respect to the rear side plate 29. Baffle pins (not shown) are fixedly protruded at both ends of the near and far sides of the unit case 14*y*. The baffle pins are engaged with respective holes (not shown) formed at the positioning member 32 and the rear side plate 29 so as to prevent the process cartridge 1*y* from rotating around the supporting shaft 16*y*.

The shaft 40*y* is driven by a motor (not shown) to rotate. The torque of the rotation is transmitted via the image bearing member gear 38*y* and the cup-shaped gear 39*y* to the supporting shaft 16*y*, which rotates the image bearing member 6*y* as previously described. Since the near side portion of the supporting shaft 16*y* is fitted into the mounting hole 37*y* of the positioning member 32 via the bearing 17*y*, the supporting shaft 16*y* can be smoothly rotated in the above-described operation.

The similar image forming operations as described above are performed for the process cartridges 1*c*, 1*m*, and 1*bk*. That is, the far side portion of each of supporting shafts 16*c*, 16*m*, and 16*bk* of the process cartridge 1*c*, 1*m*, and 1*bk* are positioned with respect to the rear side plate 29, accordingly. And, the supporting shafts 16*c*, 16*m*, and 16*bk* and the image bearing members 6*c*, 6*m*, and 6*bk* are rotated in a same manner as described above.

While the motors of the image forming apparatus 100 are stopped, when the front door of the image forming apparatus 100 is opened and the positioning member 32 is rotated to an open positioned as shown in FIG. 3 simultaneously, the opening 31 becomes open.

When any of the process cartridges 1*y*, 1*c*, 1*m*, and 1*bk* is pulled in a direction as indicated by arrow "E" under the above-described condition, the process cartridges 1*y*, for example, is guided by a guide rail (not shown) to be drawn toward the near side or front side of the image forming apparatus 100.

Conversely, when any of the process cartridges 1*y*, 1*c*, 1*m*, and 1*bk* is pushed in a direction as indicated by arrow "G" under the above-described condition, the process cartridge 1*y*, for example, is inserted as guided by the guide rail toward the far side of the image forming apparatus 100. At this time, as shown in FIG. 2, the image bearing member gear 38*y* is engaged with the cup-shaped gear 39*y*. Thereby, the far end portion of the supporting shaft 16*y* is positioned with respect to the frame 33. Then, the positioning member 32 is rotated to the closed position as shown in FIG. 2 so that the positioning member 32 is positioned with respect to the front side plate 28.

Under the above-described condition, the near end portion of the supporting shaft 16*y* is positioned with respect to the frame 33. By closing the front door, the image forming apparatus 100 can be made ready to start a series of image forming operations. The process cartridges 1*c*, 1*m*, and 1*bk* can be detached and attached to the main body 7 of the image forming apparatus 100 in the same manner as described above.

Referring to FIGS. 4, 5, 6, and 7, a detailed structure (according to one or more example embodiments of the present invention) of the main body 7 of the image forming apparatus 100 is described to show how to position the near side of each of the supporting members 15*y*, 15*c*, 15*m*, and 15*bk* with respect to the frame 33 of the main body 7 of the image forming apparatus 100.

Figure 4:
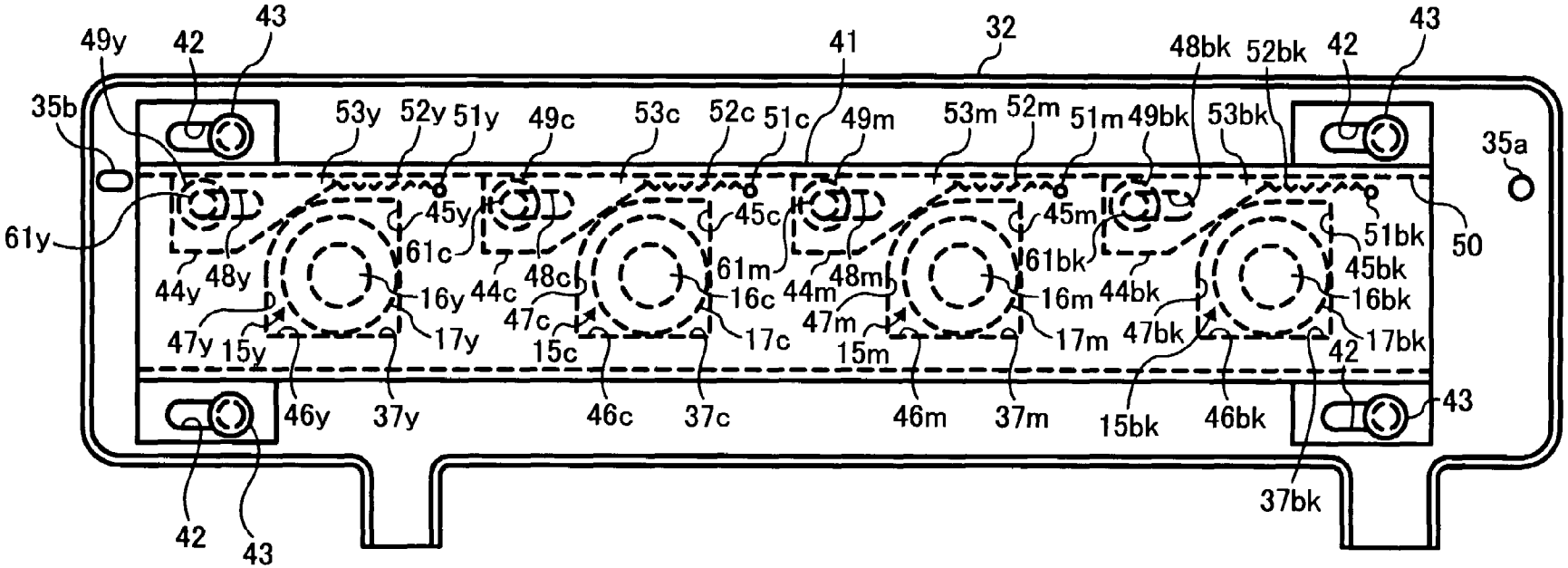
FIG. 4 is a front elevational view (according to an example embodiment of the present invention) of the positioning member and a sliding member at its first position.
Figure 5:
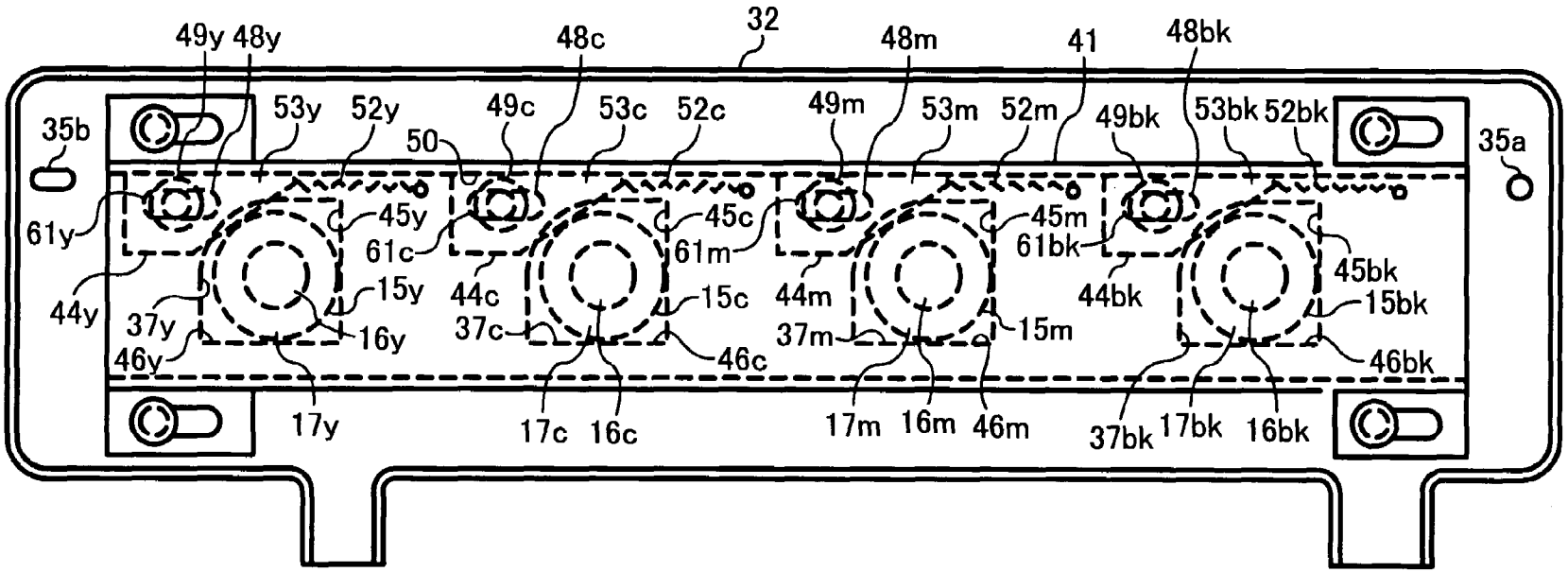
FIG. 5 is a front elevational view of the positioning member and the sliding member of FIG. 4 at its second position.
Figure 6:
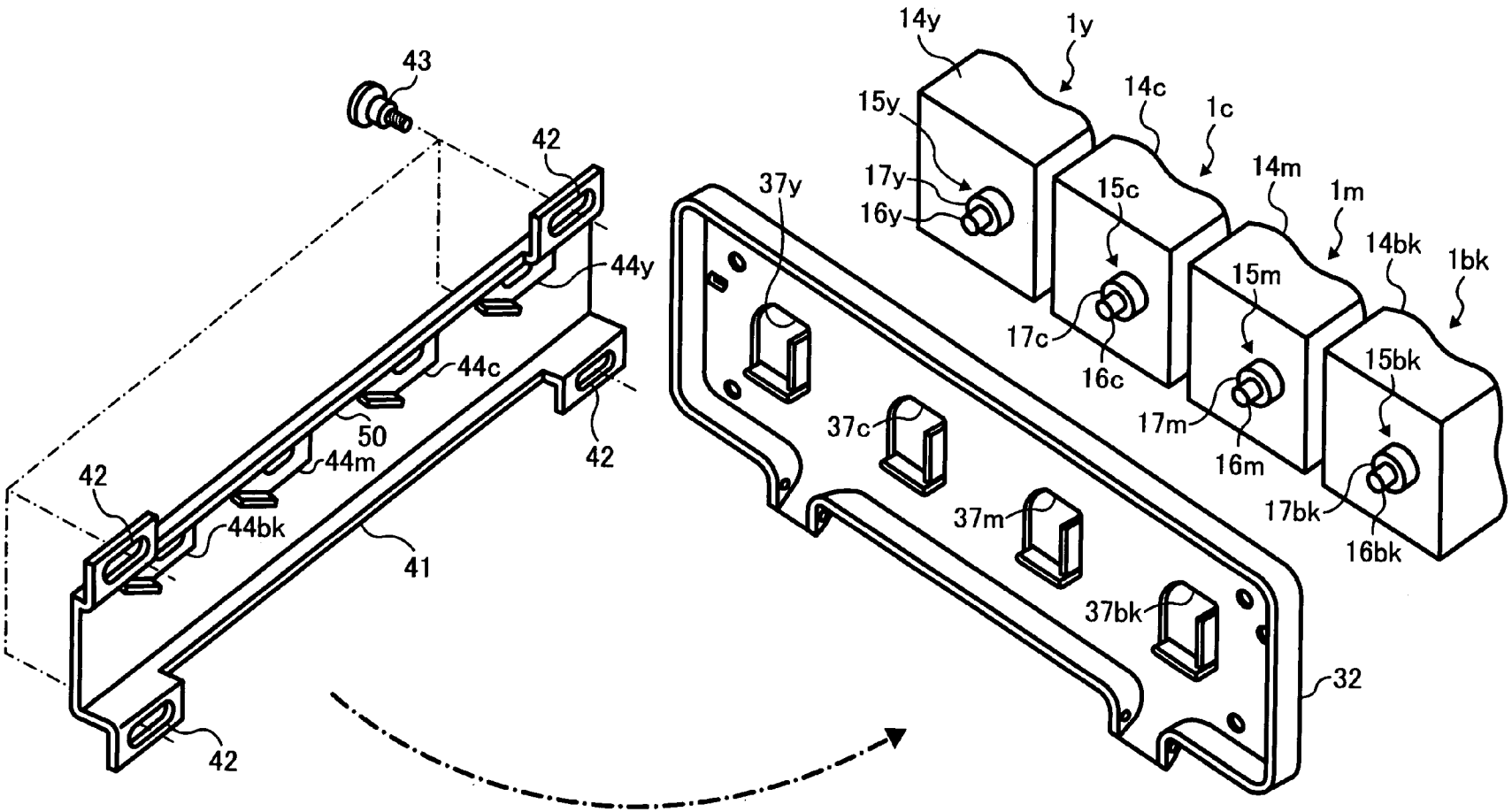
FIG. 6 is a exploded perspective view (according to an example embodiment of the present invention) of the sliding member, the positioning member, and the process cartridge.

FIG. 4 shows a structure of the main body 7 of the image forming apparatus 100 viewed in a direction indicated by arrow "IV" of FIG. 2. In FIG. 4, the process cartridges 1*y*, 1*c*, 1*m*, and 1*bk* are pushed to the far side of the main body 7 of the image forming apparatus 100, and the positioning member 32 is rotated to the closed position. The positioning holes 35*a* and 35*b* formed on the positioning member 32 are engaged with the positioning pins 36*a* and 36*b* on the front side plate 28 so that the positioning member 32 can be positioned at the mounting position. As seen from FIGS. 2, 4, and 6, the positioning member 32 is provided with a sliding member 41 having a plurality of long holes 42 in a horizontal direction. The plurality of long holes 42 are relatively engaged with shoulder screws 43 corresponding to the plurality of long holes 42. The shoulder screws 43 are screwed to the positioning member 32. With the above-described structure, the sliding member 41 is movably supported by the positioning member 32 when the sliding member 41 moves in a horizontal direction between a first position as shown in FIG. 4 and a second position as shown in FIG. 5.

The positioning member 32 in the open position as shown in FIG. 3 is rotated to the closed position as shown in FIG. 4, the bearings 17*y*, 17*c*, 17*m*, and 17*bk* may be fitted into the mounting holes 37*y*, 37*c*, 37*m*, and 37*bk* formed on the positioning member 32. At this time, as shown in FIG. 4, each size of the mounting holes 37*y*, 37*c*, 37*m*, and 37*bk* is larger than a cross sectional area of each of the bearings 17*y*, 17*c*, 17*m*, and 17*bk* respectively engaged with the respective supporting shafts 16*y*, 16*c*, 16*m*, and 16*bk*. That is, the bearings 17*y*, 17*c*, 17*m*, and 17*bk* can be fitted into the mounting holes 37*y*, 37*c*, 37*m*, and 37*bk* with a great amount of play. Therefore, the bearings 17*y*, 17*c*, 17*m*, and 17*bk* can easily be fitted into the mounting holes 37*y*, 37*c*, 37*m*, and 37*bk*.

Further, as shown in FIG. 4, each of the mounting holes 37*y*, 37*c*, 37*m*, and 37*bk* includes a vertical plane 45, a horizontal plane 46, and a curved plane 47. The vertical plane 45 and the horizontal plane 46 are disposed substantially perpendicular to each other.

Figure 7:
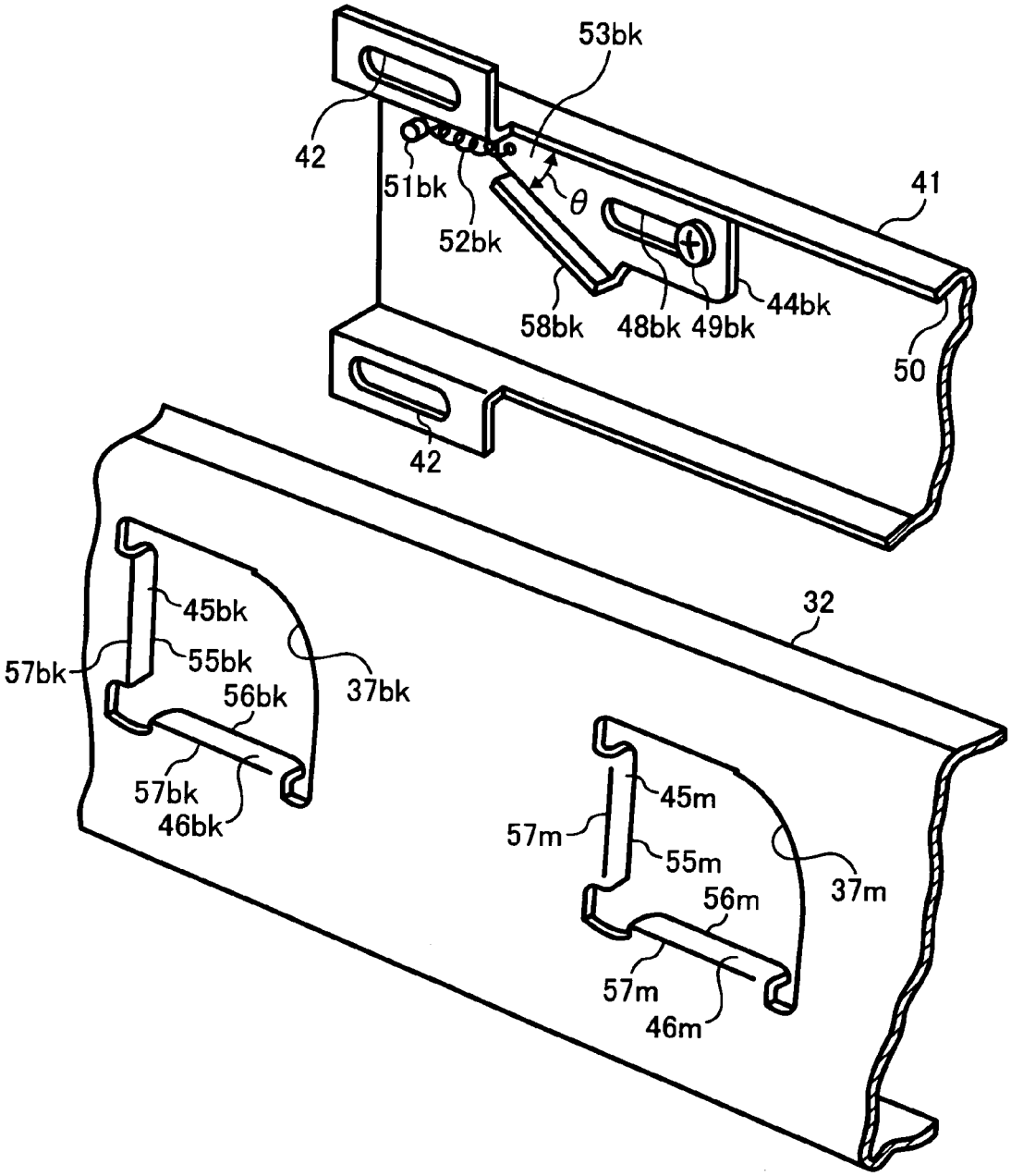
FIG. 7 is a perspective view (according to an example embodiment of the present invention) of the positioning member and the sliding member, viewed from an inside of the main body of the image forming apparatus.

On the other hand, as shown in FIGS. 2, 4, 5, and 6, respective pressing members 44*y*, 44*c*, 44*m*, and 44*bk* are disposed corresponding to the bearings 17*y*, 17*c*, 17*m*, and 17*bk*. The pressing members 44*y*, 44*c*, 44*m*, and 44*bk* have respective V-shaped portions 53*y*, 53*c*, 53*m*, and 53*bk* that are tapered. For example, the pressing member 44*bk* having the V-shaped portion 53*bk* is shown in FIG. 7.

Further, the pressing members 44*y*, 44*c*, 44*m*, and 44*bk* have respective long holes 48*y*, 48*c*, 48*m*, and 48*bk* that extend in a substantially horizontal direction. The long holes 48*y*, 48*c*, 48*m*, and 48*bk* are slidably engaged with stoppers 49*y*, 49*c*, 49*m*, and 49*bk*, respectively, which are a shoulder screw screwed to the sliding member 41 to regulate a movement of each of the pressing members 44*y*, 44*c*, 44*m*, and 44*bk*.

With the above-described structure, the pressing members 44*y*, 44*c*, 44*m*, and 44*bk* can move in a horizontal direction in a given stroke with respect to the sliding member 41.

A lower surface of a flange formed on the upper portion of the sliding member 41 serve as a guide surface 50 that serves as a guide portion guiding the pressing members 44*y*, 44*c*, 44*m*, and 44*bk*, when the pressing members 44*y*, 44*c*, 44*m*, and 44*bk* move in a horizontal direction. For the above-described reason, the sliding member 41 has the guide surface 50 for the pressing members 44*y*, 44*c*, 44*m*, and 44*bk*.

As shown in FIG. 4, tension springs 52*y*, 52*c*, 52*m*, and 52*bk* are provided to the sliding member 41. One end of the respective tension springs 52*y*, 52*c*, 52*m*, and 52*bk* is latched at the pressing members 44*y*, 44*c*, 44*m*, and 44*bk*, respectively, and the other end thereof is respectively latched at the connecting pins 51*y*, 51*c*, 51*m*, and 51*bk* protruding at the sliding member 41. With the above-described structure, the pressing members 44*y*, 44*c*, 44*m*, and 44*bk* are biased to the right side of FIG. 4. When the sliding member 41 is located at the first portion thereof as shown in FIG. 4, first end portions 61*y*, 61*c*, 61*m*, and 61*bk* of the respective long holes 48*y*, 48*c*, 48*m*, and 48*bk* are held in contact with the stoppers 49*y*, 49*c*, 49*m*, and 49*bk*, respectively, so that the pressing members 44*y*, 44*c*, 44*m*, and 44*bk* may stop at the position shown in FIG. 4. At this time, the pressing members 44*y*, 44*c*, 44*m*, and 44*bk* stay away from the corresponding bearings 17*y*, 17*c*, 17*m*, and 17*bk* of the supporting members 15*y*, 15*c*, 15*m*, and 15*bk*.

As described above, the pressing members 44*y*, 44*c*, 44*m*, and 44*bk* are movably supported by the sliding member 41 while biased by the respective tension springs 52*y*, 52*c*, 52*m*, and 52*bk*. When the sliding member 41 is located at the first position, the pressing members 44*y*, 44*c*, 44*m*, and 44*bk* respectively biased by the tension springs 52*y*, 52*c*, 52*m*, and 52*bk* are regulated by the respective stoppers 49*y*, 49*c*, 49*m*, and 49*bk* mounted on the sliding member 41 so that the pressing members 44*y*, 44*c*, 44*m*, and 44*bk* can stay away from the supporting members 15*y*, 15*c*, 15*m*, and 15*bk*, that is, the pressing members 44*y*, 44*c*, 44*m*, and 44*bk* can be prevented from contacting the supporting members 15*y*, 15*c*, 15*m*, and 15*bk*.

With the above-described structure, when an operator manually rotates the positioning member 32 from its open position as shown in FIG. 2 to its closed position as shown in FIG. 4, the bearings 17*y*, 17*c*, 17*m*, and 17*bk* can be fitted into the mounting holes 37*y*, 37*c*, 37*m*, and 37*bk*, respectively, without interfering the pressing members 44*y*, 44*c*, 44*m*, and 44*bk*.

Next, the operator manually slides the sliding member 41 with a rod-like member mounted on the sliding member 41 to the right direction in FIG. 4, to move the sliding member 41 to the second position as shown in FIG. 5. There, the V-shaped portions 53*y*, 53*c*, 53*m*, and 53*bk* of the respective pressing members 44*y*, 44*c*, 44*m*, and 44*bk* are pressed to a position between the guide surface 50 and the bearings 17*y*, 17*c*, 17*m*, and 17*bk* of the respective supporting members 15*y*, 15*c*, 15*m*, and 15*bk* so that the bearings 17*y*, 17*c*, 17*m*, and 17*bk* can be pressed toward the respective vertical planes 45*y*, 45*c*, 45*m*, and 45*bk* and the respective horizontal planes 46*y*, 46*c*, 46*m*, and 46*bk* formed on the mounting holes 37*y*, 37*c*, 37*m*, and 37*bk*, respectively.

Detailed operations are described below.

When the operator starts to slide the sliding member 41 from the first position shown in FIG. 4 to the second position in FIG. 5, the pressing members 44*y*, 44*c*, 44*m*, and 44*bk* biased by the respective tension springs 52*y*, 52*c*, 52*m*, and 52*bk* and regulated by the respective stoppers 49*y*, 49*c*, 49*m*, and 49*bk* start to move together with the sliding member 41 to the right direction of FIG. 4. Then, when the sliding member 41 come to a third position located between the first and second positions, the V-shaped portions 53*y*, 53*c*, 53*m*, and 53*bk* of the pressing members 44*y*, 44*c*, 44*m*, and 44*bk* biased by the tension springs 52*y*, 52*c*, 52*m*, and 52*bk*, respectively, are pushed to a position between the guide surface 50 and the bearings 17*y*, 17*c*, 17*m*, and 17*bk* of the respective supporting members 15*y*, 15*c*, 15*m*, and 15*bk*, and are stopped by contacting respective circumferential surfaces of the bearings 17*y*, 17*c*, 17*m*, and 17*bk*.

With the above-described operation, the pressing members 44*y*, 44*c*, 44*m*, and 44*bk* forcedly press the bearings 17*y*, 17*c*, 17*m*, and 17*bk* with respect to the vertical planes 45*y*, 45*c*, 45*m*, and 45*bk* and the horizontal planes 46*y*, 46*c*, 46*m*, and 46*bk* of the mounting holes 37*y*, 37*c*, 37*m*, and 37*bk*, respectively.

After the pressing members 44*y*, 44*c*, 44*m*, and 44*bk* are stopped, the sliding member 41 continuously moves toward the second position, the ends 61*y*, 61*c*, 61*m*, and 61*bk* of the long holes 48*y*, 48*c*, 48*m*, and 48*bk* formed on the respective pressing members 44*y*, 44*c*, 44*m*, and 44*bk* are separated from the stoppers 49*y*, 49*c*, 49*m*, and 49*bk* so that the pressing members 44*y*, 44*c*, 44*m*, and 44*bk* can be released from the force exerted by the stoppers 49*y*, 49*c*, 49*m*, and 49*bk*.

As described above, since the bearings 17*y*, 17*c*, 17*m*, and 17*bk* press contact with the vertical planes 45*y*, 45*c*, 45*m*, and 45*bk* and the horizontal planes 46*y*, 46*c*, 46*m*, and 46*bk* of the mounting hole 37*y*, 37*c*, 37*m*, and 37*bk*, respectively, the near side portions of the supporting members 15*y*, 15*c*, 15*m*, and 15*bk* and the image bearing members 6*y*, 6*c*, 6*m*, and 6*bk* supported by the corresponding supporting members 15*y*, 15*c*, 15*m*, and 15*bk* are properly positioned to the positioning member 32. At this time, the positioning member 32 is properly positioned with respect to the frame 33. Accordingly, the image bearing members 6*y*, 6*c*, 6*m*, and 6*bk* are properly positioned with respect to the frame 33 of the main body 7 of the image forming apparatus 100.

By setting the positioning member 32 to the mounting position with respect to the frame 33 and moving the sliding member 41, the image bearing members 6*y*, 6*c*, 6*m*, and 6*bk* can be positioned with respect to the main body 7 of the image forming apparatus 100. Moreover, each size of the mounting holes 37*y*, 37*c*, 37*m*, and 37*bk* formed on the positioning member 32 can be made larger than a cross sectional area at the near side end of each of The supporting members 15*y*, 15*c*, 15*m*, and 15*bk*. Thereby, the supporting members 15*y*, 15*c*, 15*m*, and 15*bk* can easily be fitted into the mounting holes 37*y*, 37*c*, 37*m*, and 37*bk*.

As described above, the image forming apparatus 100 of the example embodiment includes the pressing members 44*y*, 44*c*, 44*m*, and 44*bk* that respectively press supporting members 15*y*, 15*c*, 15*m*, and 15*bk* fitted into the mounting holes 37*y*, 37*c*, 37*m*, and 37*bk* to the vertical planes 45*y*, 45*c*, 45*m*, and 45*bk* and the horizontal planes 46*y*, 46*c*, 46*m*, and 46*bk*, respectively. The pressing members 44*y*, 44*c*, 44*m*, and 44*bk* have the respective V-shaped portions 53*y*, 53*c*, 53*m*, and 53*bk* that are pushed toward a position between the guide surface 50 and the supporting members 15*y*, 15*c*, 15*m*, and 15*bk* so as to press the supporting members 15*y*, 15*c*, 15*m*, and 15*bk*.

When the sliding member 41 is at the first position, the pressing members 44*y*, 44*c*, 44*m*, and 44*bk* respectively biased by the tension springs 52*y*, 52*c*, 52*m*, and 52*bk* are regulated by the stoppers 49*y*, 49*c*, 49*m*, and 49*bk* mounted on the sliding member 41 so as to stay away from the supporting members 15*y*, 15*c*, 15*m*, and 15*bk* without contacting the supporting members 15*y*, 15*c*, 15*m*, and 15*bk*.

When the sliding member 41 starts to leave from the first position for the second position, the pressing members 44*y*, 44*c*, 44*m*, and 44*bk* under the above-described condition start to move together with the sliding member 41.

When the sliding member 41 reaches the third position between the first position and the second position, the respective V-shaped portions 53*y*, 53*c*, 53*m*, and 53*bk* of the biased pressing members 44*y*, 44*c*, 44*m*, and 44*bk* are pushed to a position between the guide surface 50 and the supporting members 15*y*, 15*c*, 15*m*, and 15*bk*, and then stop.

When the sliding member 41 further moves toward the second position, the pressing members 44*y*, 44*c*, 44*m*, and 44*bk* are released from the force exerted by the stoppers 49*y*, 49*c*, 49*m*, and 49*bk*.

Thus, the sliding member 41, the pressing members 44*y*, 44*c*, 44*m*, and 44*bk*, the tension springs 52*y*, 52*c*, 52*m*, and 52*bk*, and the stoppers 49*y*, 49*c*, 49*m*, and 49*bk* are positioned.

When the sliding member 14 reaches to the second position as shown in FIG. 5, respective V-shaped portions 53*y*, 53*c*, 53*m*, and 53*bk* of the biased pressing members 44*y*, 44*c*, 44*m*, and 44*bk* are pushed to a position between the guide surface 50 and the respective circumferential surfaces of the bearings 17*y*, 17*c*, 17*m*, and 17*bk*. With the frictional force, the sliding member 41 can be held at the second position to properly position the image bearing members 6*y*, 6*c*, 6*m*, and 6*bk*. When the operator manually slides the sliding member 41 to the first position as shown in FIG. 4, the pressing members 44*y*, 44*c*, 44*m*, and 44*bk* may leave from the respective circumferential surfaces of the bearings 17*y*, 17*c*, 17*m*, and 17*bk*. Thereby, the positioning member 32 can be rotated to the open position as shown in FIG. 3.

Further, the vertical planes 45*y*, 45*c*, 45*m*, and 45*bk* and the horizontal planes 46*y*, 46*c*, 46*m*, and 46*bk* are mounted on the respective mounting holes 37*y*, 37*c*, 37*m*, and 37*bk* and are pressed by the supporting members 15*y*, 15*c*, 15*m*, and 15*bk* are formed substantially perpendicular to each other. Therefore, the supporting members 15*y*, 15*c*, 15*m*, and 15*bk* can be held in a stable manner to be properly positioned.

Further, the V-shaped portions 53*y*, 53*c*, 53*m*, and 53*bk* of the pressing members 44*y*, 44*c*, 44*m*, and 44*bk* have respective angles as represented by "θ".

For example, as shown in FIG. 7, the V-shaped portion 53*bk* has the angle "θ".

When the angle "θ" is too great, the respective V-shaped portion 53*bk* may be pushed with a large force to the position between the guide surface 50 and the bearing 17*bk* (not shown in FIG. 7), which can degrade operability of the image forming apparatus 100. Conversely, when the angle "θ" is too small, the operation stroke of the pressing member 44*y*, 44*bk* may increase, which may also degrade the operability. Accordingly, for example, the angle "θ" can be set to a range from about 5 degrees to about 45 degrees. As a more specific example, the angle θ is set to a range from about 15 degrees to about 20 degrees.

Further, the respective two planes, that are the respective vertical planes 45*y*, 45*c*, 45*m*, and 45*bk* and the respective horizontal planes 46*y*, 46*c*, 46*m*, and 46*bk*, of the mounting holes 37*y*, 37*c*, 37*m*, and 37*bk* formed on the positioning member 32 are formed to have tongue-shaped pieces 55 and 56, including tongue-shaped pieces 55*y*, 55*m*, 56*y*, and 56*m*, which are shaped using a cutting and raising process in a press molding. For example, as shown in FIG. 7, the vertical planes 45*m* and 45*bk* and the horizontal planes 46*m* and 46*bk* of the respective mounting holes 37*m* and 37*bk* have respective tongue-shaped pieces 55*m* and 55*bk*, and 56*m* and 56*bk*. Thereby, round portions 57*m* and 57*bk* in FIG. 7 are formed at the base of each of the tongue-shaped pieces 55*m*, 55*bk*, 56*m*, and 56*bk*. With the above-described structure, when the positioning member 32 is rotated to the closed position as shown in FIG. 2, the bearing 17*y* may slidably contact with the round portion 57*y*, which can protect (if not completely prevent) the bearing 17*y* from being damaged.

Similarly to the above-described structure of the two planes of the mounting holes 37*y*, 37*c*, 37*m*, and 37*bk*, a plane of each of the pressing members 44*y*, 44*c*, 44*m*, and 44*bk* contacting the supporting members 15*y*, 15*c*, 15*m*, and 15*bk* is formed to have a tongue-shaped piece 58 that is shaped using the cutting and raising process in a press molding, thereby forming a round portion 60*y* at the base of the tongue-shaped piece 58*y* as shown in FIG. 2. With the above-described structure, when the pressing members 44*y*, 44*c*, 44*m*, and 44*bk* contact the bearings 17*y*, 17*c*, 17*m*, and 17*bk* of the respective supporting members 15*y*, 15*c*, 15*m*, and 15*bk*, the bearings 17*y*, 17*c*, 17*m*, and 17*bk* can be protected (if not completely prevented) from being damaged.

As described above, the image forming apparatus 100 includes the plurality of image bearing members 6*y*, 6*c*, 6*m*, and 6*bk*, and the respective supporting members 15*y*, 15*c*, 15*m*, and 15*bk*. The plurality of pressing members 44*y*, 44*c*, 44*m*, and 44*bk* pressing the respective supporting members 15*y*, 15*c*, 15*m*, and 15*bk* are movably supported by the sliding member 41. Therefore, moving the sliding member 41 can move the entire pressing members 44*y*, 44*c*, 44*m*, and 44*bk*, which can press the respective supporting members 15*y*, 15*c*, 15*m*, and 15*bk* to the two planes of the respective mounting holes 37*y*, 37*c*, 37*m*, and 37*bk*.

Further, in the image forming apparatus 100, the image bearing members 6*y*, 6*c*, 6*m*, and 6*bk* are fixedly supported to the supporting shafts 16*y*, 16*c*, 16*m*, and 16*bk* of the supporting members 15*y*, 15*c*, 15*m*, and 15*bk*, respectively. By rotating the supporting shafts 16*y*, 16*c*, 16*m*, and 16*bk* of the respective supporting members 15*y*, 15*c*, 15*m*, and 15*bk*, the image bearing members 6*y*, 6*c*, 6*m*, and 6*bk* are rotated. To perform this operation, the bearings 17*y*, 17*c*, 17*m*, and 17*bk* are mounted on the front side portion of the respective supporting shafts 16*y*, 16*c*, 16*m*, and 16*bk* of the respective supporting members 15*y*, 15*c*, 15*m*, and 15*bk*, so that the bearings 17*y*, 17*c*, 17*m*, and 17*bk* can be fitted into the mounting holes 37*y*, 37*c*, 37*m*, and 37*bk*.

As an alternative, the image bearing members 6*y*, 6*c*, 6*m*, and 6*bk* can be rotatably supported to the supporting shafts 16*y*, 16*c*, 16*m*, and 16*bk* of the supporting members 15*y*, 15*c*, 15*m*, and 15*bk*, respectively. In this case, when the image bearing members 6*y*, 6*c*, 6*m*, and 6*bk* are driven to rotate without rotating the supporting shafts 16*y*, 16*c*, 16*m*, and 16*bk* of the respective supporting members 15*y*, 15*c*, 15*m*, and 15*bk*, the supporting shafts 16*y*, 16*c*, 16*m*, and 16*bk* can be directly fitted into the mounting holes 37*y*, 37*c*, 37*m*, and 37*bk*. Accordingly, in this case, the respective supporting members 15*y*, 15*c*, 15*m*, and 15*bk* do not have the bearings 17*y*, 17*c*, 17*m*, and 17*bk* to be fitted into the mounting holes 37*y*, 37*c*, 37*m*, and 37*bk*.

Further, in the image forming apparatus 100, the supporting shafts 16*y*, 16*c*, 16*m*, and 16*bk* are integrally mounted to the image bearing members 6*y*, 6*c*, 6*m*, and 6*bk*, respectively. However, as an alternative, a supporting shaft can be rotatably or non-rotatably mounted to a frame of a main body of an image forming apparatus so as to detachably mount an image bearing member in an axial direction of the supporting shaft. The above-described structure can be employed in such image forming apparatus.

Further, when the supporting shaft is rotatably mounted to the frame, the image bearing member supporting member may include the supporting shaft and a bearing mounted at the near side portion of the supporting shaft. When the supporting shaft is non-rotatably mounted to the frame, the supporting shaft may directly be fitted into a mounting hole of a positioning member.

The above-described structures according to one or more embodiments of the present invention can be applied to an image forming apparatus that includes on image bearing member.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

With some example embodiments of the present invention having thus been described, it will be obvious that the same may be varied in many ways. Such variations are not to be regarded as a departure from the spirit and scope of the present invention, and all such modifications are intended to be included within the scope of the present invention.

What is claimed is:

1. An image forming apparatus, comprising:

an image bearing member configured to bear an image on a surface thereof;

a supporting member configured to support the image bearing member;

a sliding member having a guide portion extending from the sliding member;

a positioning member configured to be detachably positioned at a given position on the sliding member, the positioning member including a fitting portion having planes and configured to fit with the supporting member while the positioning member being positioned at the given position; and a pressing member configured to press the image bearing member supporting member toward the planes of the fitting portion, the pressing member having a V-shaped portion so that the V-shaped portion is pushed between the guide portion and the supporting member to press the supporting member.

2. The image forming apparatus according to claim 1, wherein:

the sliding member is configured to move between first and second positions and further includes a regulating member mounted thereon configured to regulate movement of the pressing member, and the pressing member is movably supported by the positioning member while being biased by a spring, both ends of which are locked by the sliding member and the pressing member.

3. The image forming apparatus according to claim 2, wherein respective positions of the sliding member, the pressing member, the spring, and the regulating member are determined such that:

when the sliding member is located at the first position, the pressing member biased by the spring is regulated by the regulating member to stay away from the image bearing member supporting member;

when the sliding member leaves from the first position for the second position, the pressing member moves together with the sliding member;

when the sliding member comes to a third position located between the first and the second positions, the V-shaped portion is pushed to a position between the guide portion and the image bearing member supporting member, and then is stopped when the sliding member further moves toward the second position, the pressing member is released from a force exerted by the regulating member.

4. The image forming apparatus according to claim 1, wherein:

the planes are disposed substantially perpendicular to each other.

5. The image forming apparatus according to claim 1, wherein:

the V-shaped portion of the pressing member has an angle between about 5 degrees and about 45 degrees.

6. The image forming apparatus according to claim 5, wherein:

the V-shaped portion of the pressing member has an angle between about 15 degrees and about 20 degrees.

7. The image forming apparatus according to claim 1, wherein:

the planes of the fitting portion are formed by respective tongue-shaped pieces produced by using a cutting and raising process.

8. The image forming apparatus according to claim 1, wherein:

a portion of the pressing member contacting with the image bearing member supporting member is formed by a tongue-shaped piece produced by using a cutting and raising process.

9. The image forming apparatus according to claim 3, wherein the apparatus includes:

plural instances of the image bearing member, plural instances of the supporting member configured to support the plural instances of the image bearing member, respectively, and plural instances of the pressing member configured to press the respective plural instances of the supporting member; and wherein the plural instances of the pressing member are movably disposed on the sliding member.

10. An image forming apparatus, comprising:

bearing means for bearing an image on a surface thereof;

supporting means for supporting the bearing means;

moving means for moving having a guide portion extending from the moving means;

positioning means for positioning the supporting means, the positioning means including fitting means for fitting having planes and that is fitted with the supporting means while the positioning means is positioned at a given position; and pressing means for pressing the supporting means toward the planes of the fitting means, the pressing means having a V-shaped portion so that the V-shaped portion is pushed between the guide portion and the supporting means to press the supporting means.

11. The image forming apparatus according to claim 10, wherein:

the moving means moves between first and second positions and further includes regulating means for regulating a movement of the pressing means, and the pressing means is movably supported by the positioning means while being biased by a spring, ends of which are locked by the moving means and the pressing means.

12. The image forming apparatus according to claim 11, wherein respective positions of the moving means, the pressing means, the spring, and the regulating means are determined such that:

when the moving means is located at the first position, the spring-biased pressing means is regulated by the regulating means to stay away from the supporting means;

when the moving means leaves from the first position for the second position, the pressing means moves together with the moving means;

when the moving means comes to a third portion located between the first and the second positions, the V-shaped portion is pushed to a position between the guide portion and the supporting means, and then is stopped; and when the moving means further moves toward the second position, the pressing means is released from a force exerted by the regulating means.

13. The image forming apparatus according to claim 10, wherein:

the planes are disposed substantially perpendicular to each other.

14. The image forming apparatus according to claim 12, wherein:

the pressing means is movably disposed on the moving means.

15. A method of positioning an image bearing member supporting member, comprising the steps of:

mounting the image bearing member supporting member to an image forming apparatus;

closing a cover of the image forming apparatus to fit the image bearing member supporting member into a fitting hole formed on a positioning member mounted with respect to the cover;

moving a sliding member in a given direction;

contacting a pressing member mounted on the sliding member with the image bearing member supporting member;

moving the sliding member to a given position;

pushing a V-shaped portion of the pressing member between a guide portion of the sliding member and the image bearing member supporting member such that the pressing member contacts a surface of the guide portion to press the image bearing member supporting member; and engaging the image bearing member supporting member with the positioning member.

16. The method according to claim 15, further comprising the step of:

regulating a movement of the pressing member; and supporting the pressing member by a spring, both ends of which are locked by the sliding member and the pressing member.

17. The method according to claim 16, wherein respective positions of the sliding member, the pressing member, the spring, and the regulating member are determined such that:

when the sliding member is located at the first position, the pressing member biased by the spring is regulated by the regulating member to stay away from the image bearing member supporting member;

when the sliding member leaves from the first position for the second position, the pressing member moves together with the sliding member;

when the sliding member comes to a third position located between the first and the second positions, the V-shaped portion is pushed to a position between the guide portion and the image bearing member supporting member, and the is stopped when the sliding member further moves toward the second position, the pressing member is released from a force exerted by the regulating member.

18. The method according to claim 16, further comprising the step of:

forming respective tongue-shaped pieces produced by using a cutting and raising process for planes of the fitting hole and a portion of the pressing member which contacts with the image bearing member supporting member.

19. The image forming apparatus according to claim 1, wherein:

the pressing member contacts a surface of the guide portion.

20. The image forming apparatus according to claim 1, wherein:

the pressing member extends from a planar surface of the sliding member.

* * * * *